United States Patent [19]

Tran et al.

[11] Patent Number: 4,827,192

[45] Date of Patent: May 2, 1989

[54] OUTPUT CIRCUIT FOR KLYSTRON AND KLYSTRON WITH AN OUTPUT CIRCUIT OF THIS TYPE

[75] Inventors: Duc T. Tran, Bures sur Yvette; Georges Faillon, Meudon, both of France

[73] Assignee: Thomson-CSF, Paris, France

[21] Appl. No.: 26,302

[22] Filed: Mar. 16, 1987

[30] Foreign Application Priority Data

Mar. 19, 1986 [FR] France ..... 86 03949

[51] Int. Cl.[4] ..... H01J 25/10

[52] U.S. Cl. ..... 315/5.39; 315/5.49

[58] Field of Search ..... 315/5.39, 5.49, 38, 315/5.14

[56] References Cited

U.S. PATENT DOCUMENTS 2,843,795 7/1958 Bondley et al. ..... 315/5.39

3,278,795 10/1966 Mihran ..... 315/5.14

4,429,255 1/1984 Pasmannik et al. ..... 315/5.39

FOREIGN PATENT DOCUMENTS 1173546 4/1957 France .

1572746 6/1968 France .

2336788 12/1975 France .

826788 1/1960 United Kingdom .

*Primary Examiner*—David K. Moore

*Assistant Examiner*—T. Salindong

*Attorney, Agent, or Firm*—Roland Plottel

[57] ABSTRACT

The output circuit according to the invention comprises a ring-shaped cavity formed by a waveguide with a section in the shape of an H that is turned back on itself. The output circuit comprises holes for coupling with the output cavity, these holes being evenly arranged on its internal cylindrical wall, and the said output circuit has at least one hole for coupling with a using circuit, set on its external cylindrical wall.

8 Claims, 2 Drawing Sheets

OUTPUT CIRCUIT FOR KLYSTRON AND KLYSTRON WITH AN OUTPUT CIRCUIT OF THIS TYPE

BACKGROUND OF THE INVENTION (1) Field of the Invention

The present invention pertains to output circuits designed for conventional single-beam as well as multiple-beam klystrons.

When used in single-beam klystrons, the output circuits according to the invention can be used to resolve the problem of manufacturing the output window for klystrons of high output power, for example of the order of several megawatts in continuous operation. The invention makes it possible to use several output windows for a single klystron without disturbing the functioning of the tube. Thus, each window is crossed by only a fraction of the output power of the tube. Even klystrons with high output power can be provided, without problems, with windows of the requisite qualities.

(2) Description of the Prior Art

Multiple-beam klystrons are known in the prior art through articles and through the French patent no. 992.853. The principle of these klystrons and their structure will be recalled in the description of FIG. 1. Nothing is specified in the prior art concerning the output circuit of these klystrons. If a single guide or a single loop is used to output the energy from the tube, a disymmetry is introduced which disturbs the functioning of the tube. Another possibility is to use as many guides or loops as there are beams, but the resulting output circuit is very bulky.

SUMMARY OF THE INVENTION

The present invention pertains to an output circuit for a klystron, this klystron comprising an output cavity to which is coupled the output circuit which is also coupled to at least one using circuit, such as a waveguide that supplies a load wherein the output circuit comprises a ring-shaped cavity formed by a waveguide with a cross-section in the shape of an H which is turned back on itself and which comprises an internal cylindrical wall and an external cylindrical wall, the output circuit comprising holes for coupling with the output cavity which are evenly arranged on its internal cylindrical wall and comprise at least one hole for coupling with a using circuit set on its external cylindrical wall.

For single-beam klystrons with high output power, the holes which couple the output circuit according to the invention with the output cavity of the klystrons are provided with windows made of dielectrical material.

For multiple-beam klystrons, the holes which provide for the coupling of the output circuit according to the invention with the output cavity of the klystrons must be positioned to face the beams.

BRIEF DESCRIPTION OF THE DRAWINGS

Other objects, characteristics and results of the invention will emerge from the following description which is given as a non-exhaustive example illustrated by the appended figures of which.

In the various figures, the same references designate the same elements but, for reasons of clarity, the sizes and proportions of the various elements are not respected.

DESCRIPTION OF THE PREFERRED EMBODIMENT

Multiple-beam klystrons are improved klystrons for which it is sought to obtain both compactness and high efficiency while, at the same time, using only a low accelerating voltage.

It is known that, in the conventional design of klystrons, these three requirements are contradictory. For high efficiency can be obtained only with a beam of low perveance, i.e. of high voltage, whereas the length of the klystrons increases as the square root of the high voltage.

To get round this difficulty, the beam can be divided into several elementary beams.

The principle may be explained as follows: let a beam be divided into N elementary beams with a current I accelerated at a voltage V and let p be the perveance and n the efficiency of conversion between the supplied power VI and the high-frequency power P. The following relationships are verified.

$$I = pV^{3/2}$$

$$P = npV^{5/2}$$

If N of these elementary beams are accelerated, in parallel, by the same voltage V, the total high-frequency power $P_{TOT}$ equals:

$$P_{TOT} = N.n.p.V^{5/2}$$

We therefore get:

$$V = \left(\frac{P_{TOT}}{N.n.p.}\right)^{2/5}$$

For one and the same high frequency power, the acceleration voltage applied between the anode and the cathode is thus divided by the factor $N^{2/5}$.

For N=6, the accelerating voltage is divided by $6^{2/5}$, i.e. substantially by a factor of 2.

Figure 1:
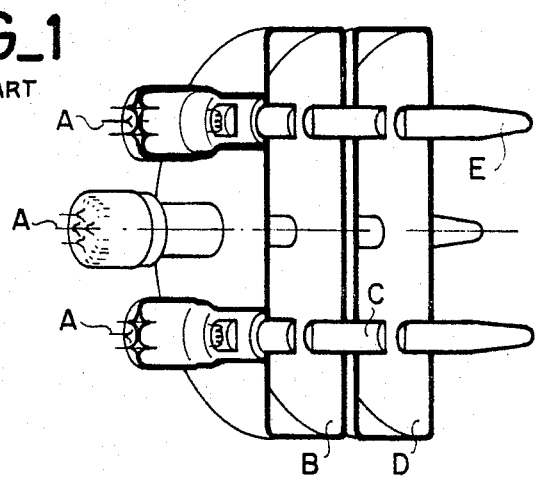
FIG 1 PRIOR ART
FIG. 1 is the diagram of a multiple-beam klystron according to the prior art.

FIG. 1 depicts the diagram of a multiple-beam klystron according to the prior art.

Single beams, emitted by electron guns bearing the reference A, cross the first cavity B, are bunched in the sliding tubes C and then release their energy in the form of high frequency signals in the output cavity D before falling on the collectors E.

As was explained in the introduction to the description, nothing is specified in the prior art as regards the output circuit of these multiple-beam klystrons.

Figure 2:
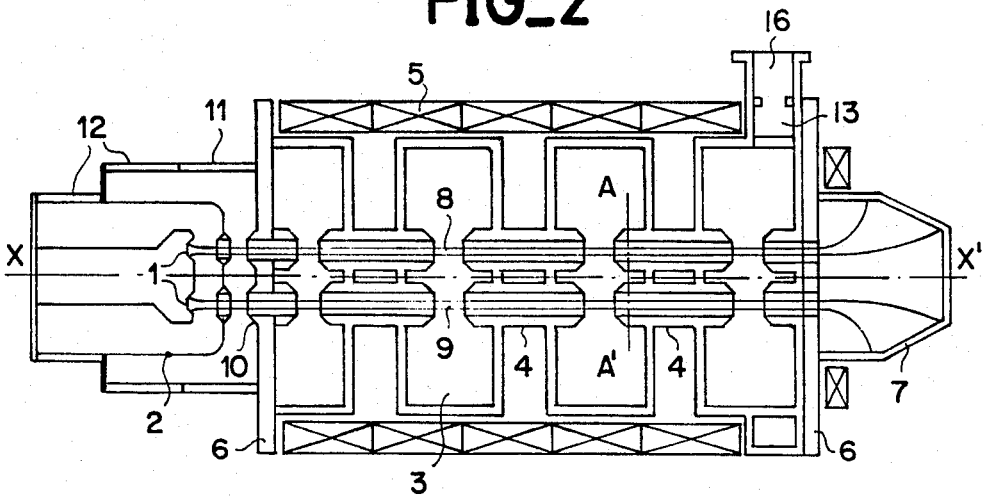
FIG. 2 is a longitudinal section view of a mode of embodiment of a multiple-beam klystron according to the invention.

FIG. 2 schematically depicts a longitudinal cross-section of a multiple-beam klystron according to a mode of embodiment of the invention.

This tube comprises electron guns comprising cathodes which bear the reference 1 and one anode with the reference 2. This anode is drilled with holes arranged to face the cathodes.

This klystron comprises four resonant cavities 3 used for the velocity modulation of the beams. Sliding tubes 4 connect the cavities to one another and provide imperviousness.

The beams are focused by a set of coils 5. It can be seen in FIG. 2 that, on either side of the set of coils 5, there are two shielding plates 6, made of a magnetic material, for example, soft iron. These plates are drilled with holes, the diameter of which is very close to that of these beams, so that the beams from the electron guns can pass through the cavities and then from the cavities to the collector 7.

Two electron beams 8 and 9 are shown in FIG. 2.

These plates 6 are surfaces which are equipotential from a magnetic point of view and contribute to creating a magnetic field along the tube which is as constant as possible.

The shielding plate 6 positioned on the guns side is used to prevent the leakage field of the coils from reaching the cathodes.

For this, the holes in this shielding plate 6 comprise a bulge 10 directed towards the cathodes. Furthermore, a cylinder 11 made of a magnetic material is attached to this shielding plate 6. This cylinder 11 is linked to other parts 12 which are made of ceramic for reasons of insulation. It is also possible to use an anode 2 made of magnetic material to improve the shielding of the cathodes.

Figure 3:
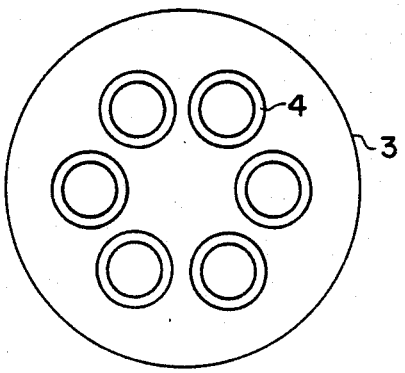
FIG. 3 is a section view along the direction AA' shown in FIG. 2.

FIG. 3 is a section view along the direction AA' indicated in the FIG. 2. It can be seen in this section view that the klystron of FIG. 2 has six drift tubes 4 and therefore, has six electron beams. The ends of a cavity 3 have been depicted, but not the focusing device.

The drift tubes are arranged in a circle centered on the longitudinal axis XX' of the tube. The angular spread between the tubes is constant. Thus, the electrical fields have an identical configuration, in each cavity, between the parts of the drift tubes which face one another.

In each cavity, the distance between the two parts of a drift tube which face each other is approximately equal to the internal diameter of the drift tube. The distribution of the electrical field between two parts of a drift tube which face each other displays a cylindrical symmetry along the longitudinal axis of the sliding tube.

Thus, each cavity 3 of the tube has high resonance frequencies which are far removed from the frequency of the fundamental mode $TM_{01}$ of the klystron.

Figure 4:
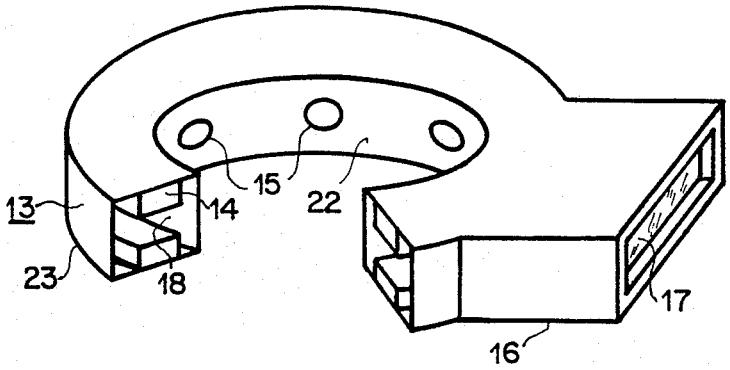
FIG. 4 is a perspective view of a mode of embodiment of an output circuit according to the invention.

FIG. 4 depicts a perspective view of a mode of embodiment of the output circuit 13 according to the invention.

This output circuit can be used to collect the high-frequency power and distribute it to the using circuit. This output circuit is coupled to the output cavity of the klystron, i.e. to the last cavity of the klystron, the one closest to the collector. This output circuit resonates at the same frequency as the output cavity of the tube, in a resonant mode $TE_{\overline{10}n}^{\square}$.

To obtain an output circuit which is as small-sized as possible and in order to avoid disturbing the working of the tube by introducing disymmetries related to the fact that the tube is often linked to only one using circuit, the output circuit used has a ring-shaped cavity formed by a waveguide with a section shaped like an H which is turned back on itself.

FIG. 4 shows this H-shaped cross-section. The solid parts 14 have not been eliminated in the example of FIG. 4 in order to simplify the manufacturing process, but they do not come into play during the operation.

Figure 5:
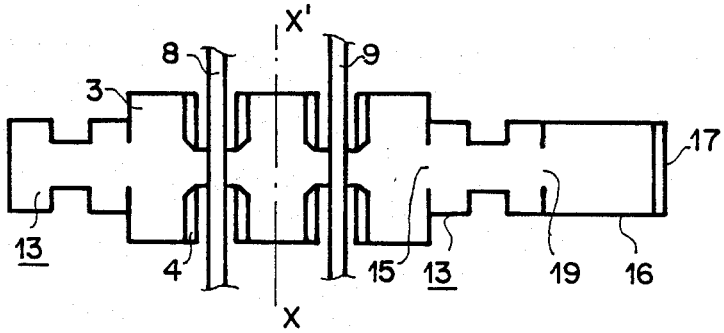
FIGS. 5 and 6 are two cross-section views depicting the output cavity and the output circuit, according to the invention, for a multiple-beam klystron and a single-beam klystron.

This output circuit 13 is positioned around the output cavity of the klystron, as can be clearly seen in FIG. 2 and in FIG. 5 which depicts the output cavity and the output circuit in greater detail than FIG. 2.

The output circuit 13 is coupled to the output cavity of the klystron by holes 15 which are evenly distributed on the output circuit wall which is in contact with the output cavity. This wall is the internal cylindrical wall 22 of the output circuit.

The number of holes N is equal to the number of klystron beams. Each hole 15 is positioned so that it faces an electron beam.

The output circuit is also coupled to the using circuit, which is a waveguide 16 in the example of FIGS. 4 and 5, by means of a hole 19 in the output circuit wall which faces the wall with the holes 15. This wall is the external cylindrical wall 23 of the output circuit.

It is possible to couple the output circuit to several using circuits.

The holes 15 may be empty as is the case in FIG. 4. In this case, it is the using circuit 16 which has a window 17 providing vacuum tightness while letting the high frequency power pass through. The window 17 can be placed at level of the coupling hole 19 between the output circuit and the using circuit, or it may be placed further away, in the guide 16, as is the case in FIG. 5.

When the output power is high, it is advantageous to place windows at each hole 15. If the klystron has N beams, hence N coupling holes 15, each window placed in a coupling hole 15 will let through only the Nth part of the total power.

The H-shaped cross-section of the output circuit 13 acts as a capacitor and can be used to obtain a resonant circuit at the frequency of the tube output cavity, but its dimensions are smaller than, for example, those for a rectangular cross-section.

The mode of operation is of the electrical transverse type.

Furthermore, another advantage of this H-shaped cross-section is that the returning part 18 of this circuit prevents the arrangement of the coupling hole or holes 19 (see FIG. 5) between the output circuit 13 and the using circuit or circuits of the tube from disturbing the symmetry of the beams. It is therefore possible, without any disadvantage, to couple the output circuit 13 by a single coupling hole 19 to a single using circuit or to couple the output circuit 13 by several coupling holes 19, positioned in any manner, to several using circuits.

As explained in the introduction to the description, the output circuit according to the invention is of great advantage when used in conventional, single-beam klystrons with high output power.

Figure 6:
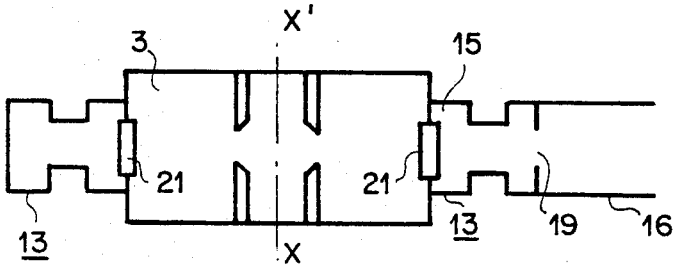

FIG. 6 is a cross-section view depicting the output cavity of a single-beam klystron and the output circuit according to the invention which is coupled to this cavity.

The single beam is propagated along the axis XX' of the klystron.

The coupling holes 15 between the output cavity and the output circuit are provided with windows 21 made of a dielectrical material which provides imperviousness. These windows are crossed by only a fraction of the total output power. If N windows are used, each window is crossed by only a fraction equal to 1/N of the total output power. It is therefore possible to have windows of the requisite qualities without difficulty.

For single-beam klystrons, the number N of coupling holes 15 is chosen according to the output power of the tube and the characteristics of the windows used.

To avoid disturbing the working of the tube, it is necessary that, as in the case of multiple-beam klystrons, the coupling holes 15 between the output cavity of the tube and the output circuit are evenly distributed on the wall of the output circuit which is in contact with the output cavity, as depicted in the example of FIG. 4.

When the output circuit according to the invention is used in a single-beam klystron, the output power of which is not high, the coupling holes 15 can be left empty and a window can be set in each using circuit.

What is claimed is:

1. A klystron arrangement comprising:

a output circuit;

a klystron resonant output cavity;

a using circuit;

said klystron resonant cavity coupled to the output circuit which is also coupled to said using circuit;

wherein said output circuit comprises a ring-shaped cavity formed by a waveguide with a cross-section in the shape of an H which is turned back on itself and which comprises an internal cylindrical wall and an external cylindrical wall, the output circuit also comprising holes for coupling with the output cavity which are evenly arranged on its internal cylindrical wall and at least one hole for coupling with the using circuit on its external cylindrical wall;

said arrangement transferring electron beam output power from said output cavity to said using circuit.

2. The arrangement of claim 1 in which the openings between the output cavity and the ring shaped cavity are closed by dielectric windows.

3. The arrangement of claim 1 in which the openings between the output cavity and the ring shaped cavity are free of windows and the openings between the ring shaped cavity and the associated using circuits are closed by dielectric windows.

4. The arrangement of claim 1 in which the klystron is a single-beam klystron.

5. The arrangement of claim 1 in which the klystron includes a plural number of electron beams and the number of openings between the output cavity and the ring shaped cavity is equal to the number of beams and each opening faces an electron beam.

6. An arrangement according to claim 5 in which the klystron includes a succession of cavities positioned along the path of electron flow of which said output cavity is the last of the succession, and means for focusing the beams arranged around the cavities.

7. An arrangement according to claim 6 in which the klystron includes a plurality of electron guns, one for each electron beam, a common anode of magnetic material for the electron beams, and shielding means including a pair of magnetic plates arranged on opposite sides of the focusing means including one proximate to the electron guns and apertured for passage of the electron beams therethrough and a magnetic cylinder attached to the plate proximate the electron guns.

8. An arrangement according to claim 6 further including along each electron beam a spaced succession of drift tubes extending between adjacent cavities of the succession of cavities and the spacing between the drift tubes is about equal to the diameter of each sliding tube.

* * * * *